United States Patent [19]

Roberts et al.

[11] 4,144,822

[45] Mar. 20, 1979

[54] FOLDING LEG MECHANISM

[75] Inventors: Kent S. Roberts; Brent J. Roberts, both of American Fork, Utah

[73] Assignee: Roberts Mfg., Inc., American Fork, Utah

[21] Appl. No.: 761,617

[22] Filed: Jan. 24, 1977

[51] Int. Cl.[2] ..... A47B 3/00

[52] U.S. Cl. ..... 108/129; 108/125

[58] Field of Search ..... 108/129, 131, 134; 248/188.6, 439; 85/5 CP; 16/72, 80

[56] References Cited

U.S. PATENT DOCUMENTS

| | | | |
|---|---|---|---|
| 851,272 | 4/1907 | Bell | 16/80 |
| 1,360,052 | 11/1920 | Streich | 108/129 |
| 2,425,162 | 8/1947 | Overby | 108/125 |
| 2,487,894 | 11/1949 | Rogers | 16/72 |
| 3,026,161 | 3/1962 | Mickelson | 108/125 UX |
| 3,037,831 | 6/1962 | Craddock et al. | 108/125 |
| 3,126,189 | 3/1964 | Van Syoc, Sr. | 108/125 |
| 3,310,268 | 3/1967 | Kramer | 248/439 X |
| 3,396,928 | 8/1968 | Lay | 108/129 X |

FOREIGN PATENT DOCUMENTS

| | | | |
|---|---|---|---|
| 793717 | 12/1968 | Canada | 108/129 |
| 85397 | 6/1965 | France | 108/129 |
| 43-155 | 1/1968 | Japan | 108/129 |

*Primary Examiner*—Roy D. Frazier
*Assistant Examiner*—Peter A. Aschenbrenner
*Attorney, Agent, or Firm*—Mallinckrodt & Mallinckrodt

[57] ABSTRACT

A folding leg mechanism for a table is adapted to be releasably locked in a firm, stable position as the leg portion thereof is swung down to extended position from retracted position against the underside of the table top. A longitudinal slot extends through at least one side of the leg and has its longitudinal axis in substantial alignment along the leg with the pivot axis about which the leg swings. A pin extends outwardly through the slot and is adapted for movement along the longitudinal axis of the slot. Spring means are provided for biasing the pin toward that end of the leg which is attached to the table. A trackway is positioned at the side of the leg from which the pin extends, so that the pin rides on and along the trackway as the leg swings between its retracted and extended positions. Abutment means are provided with which the leg makes contact when it is moved to its extended position. An upwardly extending, pin-receiving recess is positioned in the trackway so that the pin will enter it as the leg makes contact with the abutment means. As the pin enters the recess, a wedging action takes place, locking the leg in firm contact with the abutment means.

9 Claims, 6 Drawing Figures

FOLDING LEG MECHANISM

BACKGROUND OF THE INVENTION

1. Field

The invention is in the field of folding leg mechanisms for tables and the like.

2. State of the Art

Various mechanisms have been developed in the past to allow the legs of a table to be folded from extended to storage position, the latter being substantially against the underside of the table, see for example U.S. Pat. Nos. 1,726,114 and 2,823,087. Mechanical clamps or catches, such as are disclosed in Pat. No. 2,834,087, have been used to stabilize such table legs in extended position when unfolded. But these mechanical devices are bulky and complex in construction and awkward in operation.

3. OBJECTIVE

The principal objective of this invention was to develop a reliable, compact mechanism for releasably locking a folding leg for tables or the like in extended, unfolded position and for holding it in firm, steady, unyielding, and yet easily disengaged engagement with the table when extended.

SUMMARY OF THE INVENTION

In accordance with the invention, the foregoing objective is achieved by providing special locking mechanism in combination with an elongate leg which is adapted to be pivotally mounted to the underside of a table or the like for customary swinging movement between a downwardly disposed, extended position and a retracted position in which the leg lies substantially against the underside of the table. The leg includes a longitudinal slot extending along at least one of its sides with the longitudinal axis thereof substantially aligned along the leg with the pivot axis about which the leg swings. The slot opens into a hollow, coaxial core in the end of the leg which is attached to the table. The leg, can, but need not be, hollow throughout its length. Advantageously, the leg is made of tubular metal.

A pin, extending outwardly from the hollow core of the leg through the slot, is adapted to move along the longitudinal axis of the slot. Spring means are provided for biasing the pin toward the end of the leg which is attached to the table.

A trackway is positioned at the side of the leg from which the pin extends. The pin rides on and along the trackway as the leg swings between its retracted and extended positions. Abutment means are provided to act as a stop for the leg as it is swung into its extended position. The abutment means are adapted to allow the leg to swing at least slightly beyond the position at which it is normal to the underside of the table, so that the extended leg slants slightly outwardly from the table.

An upwardly extending, pin-receiving recess is positioned in the trackway so that the pin will enter the recess under the force of the spring means associated therewith as the leg is swung into its extended position and in contact with the abutment means. The longitudinal centerline of the recess is substantially normal to the table, and the longitudinal axis of the slot in the leg slants outwardly when the leg is in its extended position. As the pin enters the recess, a wedging action is produced between the pin, the slot in the leg, and the recess in the trackway. The wedging action locks the leg in firm, steady position against any further movement about its pivotal connection to the table.

The leg is readily returned to its retracted position by withdrawing the pin from the recess and rotating the leg to its retracted position. In a preferred embodiment, a second recess is provided in the trackway so that the pin will enter the second recess when the leg is in its retracted position to hold the leg in that position. The leg can again be rotated to its extended position by withdrawing the pin from the second recess.

THE DRAWING

A particular construction representing the best mode presently contemplated of carrying out the invention is illustrated in the accompanying drawing, in which;

FIG. 1 is a perspective view of a conventional table equipped with the folding leg mechanism of this invention;

FIG. 2, a fragmentary, vertical section taken along the line 2—2 of FIG. 1, showing the leg in its extended position and also showing, in phantom, the leg in an intermediate position and in a retracted position;

FIG. 3, a fragmentary, horizontal section taken along the line 3—3 of FIG. 2;

FIG. 4, a fragmentary, vertical section taken along the line 4—4 of FIG. 2, showing by dotted lines the spring means that is associated with the pin;

FIG. 5, a fragmentary, vertical section taken through the leg mechanism along line 5—5 of FIG. 4; and FIG. 6, a fragmentary section taken through the leg mechanism along line 6—6 of FIG. 5.

DETAILED DESCRIPTION OF THE ILLUSTRATED EMBODIMENT

Folding leg mechanisms of the invention are shown attached to a conventional table, such as a card table. The mechanisms are equally applicable to tables of all types, including work tables such as those used for supporting sewing machines, typewriters, etc.

Figure 2:
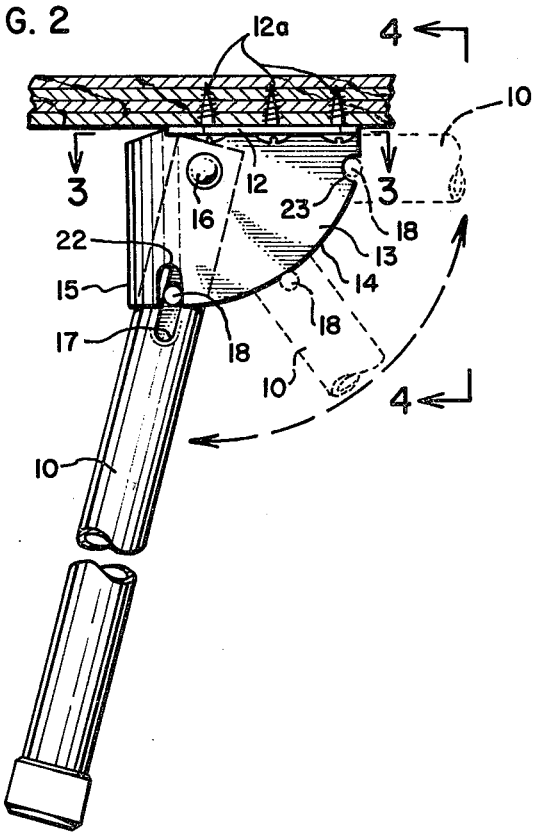

As illustrated, each leg mechanism comprises an elongate hollow leg 10 which is advantageously cut to shape from steel tubing and pivotally mounted to the underside of the table for swinging movement between a substantially downwardly disposed, extended position and a retracted position lying substantially against the underside of the table. The swinging movement of the leg is best illustrated in FIG. 2, which indicates by dotted line the arc through which the leg moves. The leg is shown in phantom in FIG. 2 in an intermediate position and in a retracted position.

Figure 3:
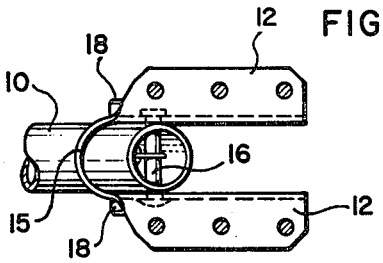

The leg 10 is attached to the table by means of a "U" shaped bracket 11. Such bracket 11 has mounting flanges 12 extending perpendicularly outwardly from the upper edges of respective, mutually parallel side walls 13 and is fastened to the underside of the table by screws **12*a*, extending through such flanges. Side walls 13 of bracket 11 have respective arcuate edges 14 extending downwardly from the table. These edges together form a trackway from the upper corner of the bracket to the lower opposite corner thereof. Side walls 13 of bracket 11 are joined together by web portion 15, FIGS. 3 and 5, which forms the closed portion of the "U" shaped bracket 11. The upper end of leg 10 is positioned between side walls 13 of bracket 11 and is pivotally connected thereto so that the leg can swing within and along the opening between arcuate edges 14 of such side walls 13**. The pivotal connection is made by a rivet 16 serving as a pivot pin. The pivot axis is spaced sufficiently far from web 15 that, as leg 10 is swung from its retracted position to its extended position, it swings at least slightly beyond the position at which it is normal to the underside of the table and therefore slants outwardly from the perpendicular by an angle of at least about 7°, but preferable from about 10° to 25°.

Figure 4:
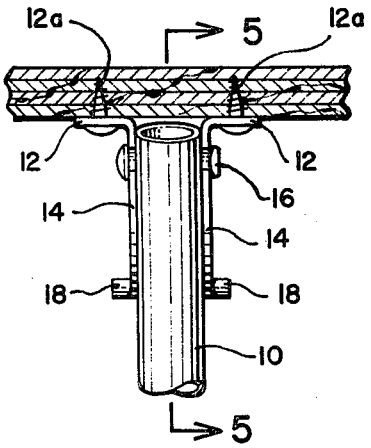

Mutually opposite, longitudinal slots 17, FIGS. 2 and 4, extend along opposite sides of leg 10 and have their respective longitudinal axes substantially aligned along leg 10 with the pivot axis about which the leg swings. Slots 17 communicate with the hollow interior of the tubular leg. If the leg is made of bar stock instead of tube, a hollow core should be bored inwardly from the pivoted end of the leg in communication with slots 17.

A pin 18 is slidably positioned within slots 17, bridging the hollow interior of the leg and projecting outwardly at opposite sides thereof. Such pin 18 passes through, and has securely mounted thereon, a slide member 19, FIG. 5 and 6, which is positioned within and is adapted to slide along the hollow interior of leg 10. A spring 20 is attached to and extends between slide member 19 and pivot pin 16 of leg 10. Such spring 20 urges the slide member 19 and pin 18 toward the pivoted end of leg 10, so that the projecting ends of pin 18 are held in contact with the respective tracks 14 of the trackway formed thereby. As leg 10 is rotated about its pivot axis 16, the projecting ends of pin 18 ride on and along the respective tracks 14. The slide member 19 can be formed from a solid piece of material such as wood with the pin 18 being driven through a snug fitting opening through the solid member. Preferably, as illustrated, slide member 19 comprises a substantially U-shaped member bent to shape from a strip of sheet metal. Mutually opposite openings are provided in the respective leg portions of the U-shaped member. The openings are of a size that the pin 18 can be inserted and slid lengthwise through the openings. Spaced, circumferential recesses are provided in the pin 18 so as to correspond to and engage the respective openings in the U-shaped member. The spring 20 holds the U-shaped member against the pin 18, and the pin 18 is thus restrained from movement relative to the U-shaped member by the engagement of the openings in the U-shaped member with the circumferential recesses in the pin 18.

Preferable, tracks 14 are arcuate. However, they could be straight, with a constant slope from respective upper corners of bracket 11 to respective lower corners thereof. Further, bracket 11 could be modified from the embodiment shown in the drawings to have only one side wall 13 positioned at one side of the leg. In such case, there would be but one track 14 and pin 18 would have to extend from only one side of the leg.

Figure 1:
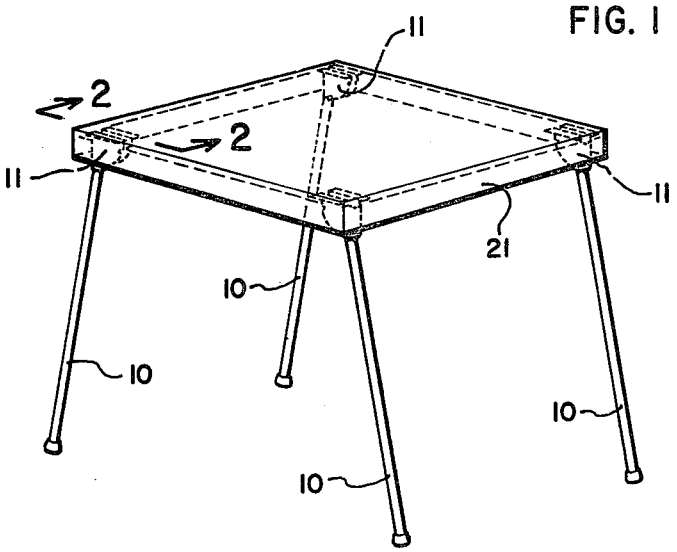

As illustrated, web portion 15 of bracket 11 forms an abutment, which acts as a stop for leg 10 as it is swung into its extended position. If a modified bracket is used, which provides only one track along one side of the leg, a flange could extend from the trackway in a similar manner as the web portions so as to provide an abutment for the leg. If preferred, separate abutment means could be attached to the underside of the table to act as a stop for the leg. Side boards are provided on many tables (see 21, FIG. 1) and could be utilized as the abutment means. The abutment means should be adapted or positioned to allow the leg to swing to an extended position, slanting outwardly from the perpendicular as described hereinabove.

Figure 5:
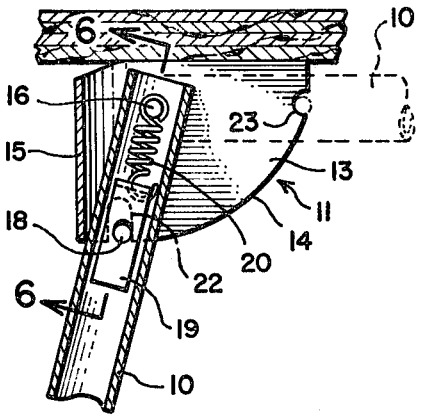
Figure 6:
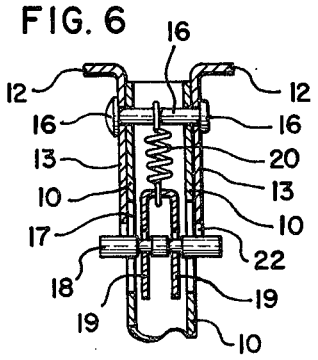

Upwardly-extending, pin-receiving recesses 22, FIGS. 2 and 5, are positioned in the respective tracks 14, so that the projecting end portions of pin 18 will enter thereinto under the force of spring 20 when leg 10 is swung into its extended position in contact with abutment means 15. The longitudinal centerlines of the respective recesses 22 are substantially normal to attachment flanges 12 and, therefore, to the underside of the table when attached. Accordingly, when the legs of a table are in extended positions, the longitudinal axes of the respective pairs of slots 17 slant outwardly. As a result, when the ends of pin 18 of a leg 10 enter the respective recesses 22, a wedging action is produced between the pin 18, the slots 17, and the recesses 22 in the tracks 14. This locks the leg in firm and steady contact with abutment means 15, so that any play in the leg, i.e., any rocking movement of the leg about its pivot axis 16, is prevented.

Legs 10 of a table can be readily returned to their retracted positions substantially against the underside of the table by manually grasping the protruding ends of the respective pins 18 and pulling downwardly against the force of respective springs 20, so that the pins are withdrawn from the respective recesses 22. Following withdrawals of the pins and slight movement of the legs toward retracted positions, the pins are released so that they ride on respective sets of tracks 14 to the retracted positions of the legs.

A second pair of recesses 23 can be provided in tracks 14 near the underside of the table for receiving the protruding ends of pin 18 as detents when the leg reaches its fully retracted position, thereby locking the leg in such retracted position. Preferably, the recesses 23 are relatively shallow, i.e., no deeper than about the diameter of pin 18, and the lower edges of the recesses 23 are slightly rounded so that the pin can be disengaged from the recesses by a downwardly-directed force exerted on the end of the leg.

Whereas this invention is here illustrated and described with specific reference to an embodiment thereof which is presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A folding leg mechanism for a table, comprising an elongate leg; means for pivotally attaching the leg to the underside of a table for swinging movement between a downwardly disposed, extended position and a folded, retracted position in which the leg lies substantially adjacent to the underside of the table; longitudinal slot means in the leg, said slot means extending at least through one side of the leg and being in substantially longitudinal alignment along the leg with the pivot axis about which the leg swings; a pin extending outwardly through said slot means for movement longitudinally therealong; spring means associated with said pin so as to apply a continuous force on the pin in a direction toward the end of said leg which is pivotally attached to said table; a trackway positioned at the side of the leg from which said pin extends, so that the pin rides on and along the trackway as the leg swings between its retracted and its extended positions; abutment means with which a lateral side of said leg makes contact when it is moved to its extended position, said abutment means being positioned so that said leg must move beyond a position in which its longitudinal axis is normal to the table top when being extended and will engage a lateral side of said leg after said leg has swung at least slightly beyond the point at which it is normal to the underside of the table; and upwardly extending, pin-receiving recess means in said trackway positioned so that said pin will enter the recess means under the force of said spring means as the leg makes contact with the abutment means, the longitudinal centerline of said recess means being substantially normal to the table, whereby when the pin enters the recess means, a wedging action is produced between the pin, a side of the recess means that confronts said abutment, and a side of said slot means that confronts said side of the recess means, which action urges the leg against said abutment means and locks it in position against any further movement about its pivotal connection to the table.

2. A folding leg mechanism in accordance with claim 1, wherein the leg is hollow adjacent to the longitudinal slot means and said slot means includes slots in mutually opposite sides of said leg; the pin extends outwardly from said slots at both sides of the leg; and the trackway includes tracks at the respective opposite sides of the leg from which said pin extends, so that the extending ends of the pin rides on and along the respective tracks as the leg swings between its retracted and its extended positions.

3. A folding leg mechanism in accordance with claim 2, wherein the tracks are formed by a U-shaped bracket comprising a pair of mutually spaced and parallel walls which receive the leg and extend downwardly from the underside of the table when the leg mechanism is attached to a table, and a web member joining said walls together.

4. A folding leg mechanism in accordance with claim 3, wherein the abutment means are provided by the lower end of the web member.

5. A folding leg mechanism in accordance with claim 3, wherein the tracks are arcuate.

6. A folding leg mechanism in accordance with claim 3, wherein detent recesses are provided in the respective tracks adjacent to their upper ends for receiving the extending ends of the pin when the leg is in retracted position.

7. A folding leg mechanism in accordance with claim 2, wherein there is a slide member within the hollow of the leg through which the pin passes, and the spring means is connected between the slide member and the leg adjacent the pivot axis of said leg.

8. A folding leg mechanism in accordance with claim 7, wherein the slide member comprises a strip of sheet metal bent upon itself to form a substantially U-shaped member; mutually opposite openings are provided in the respective leg portions of the U-shaped member through which the pin passes; and said pin has spaced, circumferential recesses which engage the respective openings in the U-shaped member.

9. A folding leg mechanism in accordance with claim 1, wherein detent means are provided for retaining the leg in retracted position.

* * * * *